US007383947B2

(12) United States Patent
Naimo

(10) Patent No.: US 7,383,947 B2
(45) Date of Patent: Jun. 10, 2008

(54) JEWELRY PRESENTATION FOLDER

(75) Inventor: Joseph L. Naimo, Kentwood, MI (US)

(73) Assignee: Baudville Inc., Grand Rapids, MI (US)

( * ) Notice: Subject to any disclaimer, the term of this patent is extended or adjusted under 35 U.S.C. 154(b) by 517 days.

(21) Appl. No.: 11/023,735

(22) Filed: Dec. 28, 2004

(65) Prior Publication Data

US 2005/0139494 A1 Jun. 30, 2005

Related U.S. Application Data

(60) Provisional application No. 60/533,339, filed on Dec. 30, 2003.

(51) Int. Cl.
*A45C 11/04* (2006.01)

(52) U.S. Cl. ..... 206/6.1; 229/77

(58) Field of Classification Search ..... 206/6.1, 206/232, 566, 581; 229/77, 78.1, 78.2
See application file for complete search history.

(56) References Cited

U.S. PATENT DOCUMENTS

| | | | | | |
|---|---|---|---|---|---|
| 25,842 | A | | 10/1859 | McEvoy | |
| 1,131,135 | A | | 3/1915 | Hudson | |
| 1,193,588 | A | | 8/1916 | Mitchell | |
| 1,465,888 | A | | 8/1923 | Wozny | |
| 1,691,781 | A | * | 11/1928 | Meyer | 206/760 |
| 1,866,156 | A | | 7/1932 | Forbes | |
| 1,957,706 | A | | 5/1934 | Fitzgerald | |
| 1,969,757 | A | | 8/1934 | Macondray et al. | |
| 2,546,542 | A | | 3/1951 | Hurt | |
| 2,885,756 | A | * | 5/1959 | Meeker | 24/97 |
| 3,430,761 | A | * | 3/1969 | Pelkey | 206/309 |
| 4,043,449 | A | * | 8/1977 | Love | 206/232 |
| 4,099,611 | A | * | 7/1978 | Feibelman | 206/6.1 |
| 4,718,554 | A | * | 1/1988 | Barbato | 206/477 |
| 4,739,878 | A | * | 4/1988 | DiDomenico | 206/6.1 |
| 4,944,389 | A | * | 7/1990 | Robertson | 206/6.1 |
| 5,078,264 | A | | 1/1992 | Garganese | |
| 5,197,596 | A | * | 3/1993 | Garganese | 206/6.1 |
| 5,593,025 | A | * | 1/1997 | Feibelman | 206/6.1 |
| 6,371,285 | B1 | * | 4/2002 | DuBois | 206/6.1 |
| 6,471,053 | B1 | | 10/2002 | Feibelman | |

* cited by examiner

*Primary Examiner*—David T. Fedei
(74) *Attorney, Agent, or Firm*—Price, Heneveld, Cooper, DeWitt & Litton, LLP

(57) ABSTRACT

A folder including an item of jewelry securing the folder in a closed position. The item of jewelry can be removed from the presentation device and used as jewelry.

16 Claims, 5 Drawing Sheets

JEWELRY PRESENTATION FOLDER

CROSS-REFERENCE TO RELATED APPLICATION

This application claims the benefit of U.S. Provisional Application No. 60/533,339, filed Dec. 30, 2003, entitled JEWELRY PRESENTATION FOLDER.

BACKGROUND OF THE INVENTION

The present invention relates to a presentation device, and more particularly, to a presentation device including an item of jewelry.

Ornamental jewelry, or more particularly jewelry which consists of a head, a shaft and a clutch, as for example a lapel pin, is typically given away during promotional events, advertisements and/or solicitations. In addition, these pins are often presented with some form of separate promotional message or advertisement.

Heretofore, these pins have typically been packaged on a card or other suitable display, whereby the pin is retained to the card with the head disposed on one side of the card and the clutch on the other. Earrings are often packaged in the same manner.

SUMMARY OF THE INVENTION

In the present invention, a presentation device includes first and second panels hingedly joined such that they can open or close with respect to each other and an item of jewelry which is releasably attached to one of the panels such that it acts as a closure for holding the panels in a closed position when attached thereto. The jewelry item can be removed from the presentation device and used as an item of jewelry.

These and other features, advantages and objects of the present invention will be further understood and appreciated by those skilled in the art by reference to the following specification, claims and appended drawings.

DETAILED DESCRIPTION OF THE PREFERRED EMBODIMENT

Figure 1:
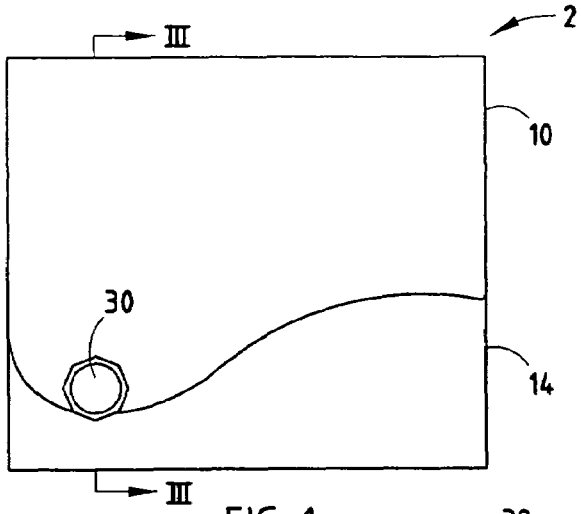
FIG. 1 is a plan view of the pin presentation folder in accordance with a first embodiment of the present invention.

For purposes of description herein, the terms "upper," "lower," "right," "left," "rear," "front," "vertical," "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are exemplary embodiments of the inventive concepts defined in the appended claims. Hence, specific dimensions and other characteristics relating to the embodiments disclosed herein are not to be considered as limiting, unless the claims expressly state otherwise. As used herein the terms promotion, advertisement, solicitation and their variants are not meant to be limiting in any manner and may refer to any text, graphic, design, message, solicitation, card, placard or other communication.

As herein described, the presentation device 2 of the preferred embodiment provides a unique system of promotion or advertising and includes a novel way of presenting and/or securely retaining a message or document within a folder through the use of a lapel pin or similar item of jewelry. For example, it is envisioned that a university could use presentation device 2 to securely retain and present diplomas to a graduating class. The lapel pin, which could be a college or alumni lapel pin, would secure the diploma within the presentation folder by retaining the presentation folder in a closed position. The student then has the option of retaining the diploma and lapel pin together in the presentation folder or may separate the lapel pin from the presentation folder for use as an item of jewelry. In other exemplary embodiments, presentation device 2 could be used for employee encouragement, advertising or solicitation purposes wherein when the lapel pin is removed from the display card and opened, a message, advertisement or promotional campaign is revealed.

In a first embodiment (FIGS. 1 and 2), the basic elements of a presentation device 2 include a first panel 10 and a second panel 12 hingedly joined such that the panels can open or close with respect to one another. An item of jewelry 30 is releasably attached to at least one of the panels and acts as a closure for holding the panels in a closed position as illustrated in FIG. 1. Further, the item of jewelry 30 can be used as jewelry when detached from the panel.

Figure 2:
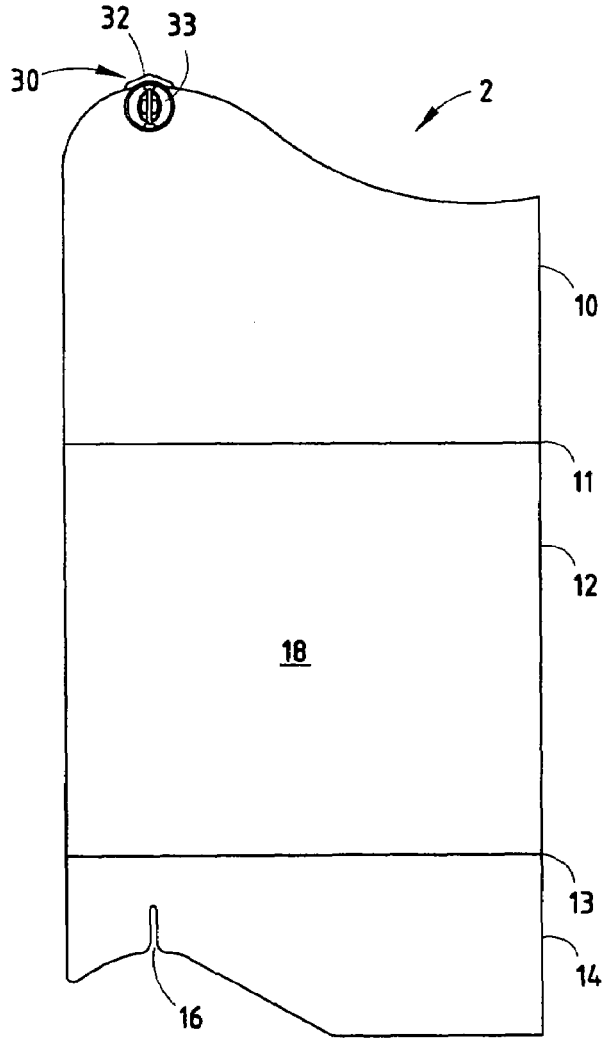
FIG. 2 is a plan view of the pin presentation folder of FIG. 1 in an unfolded state showing a first side.
Figure 4:
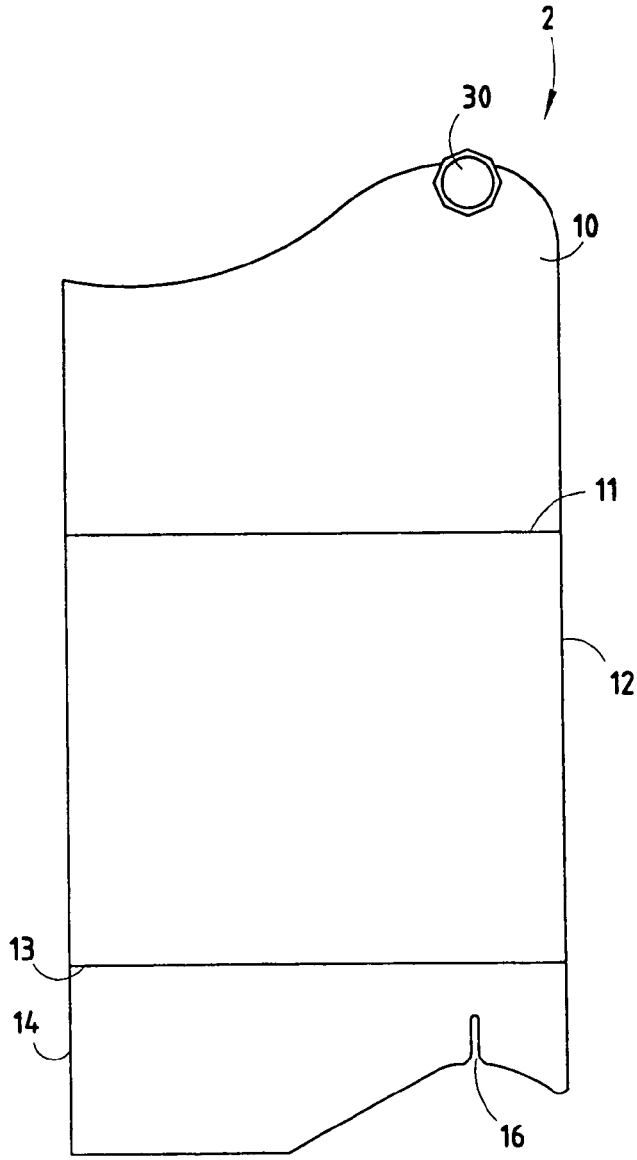
FIG. 4 is a plan view of a second, opposite side of the pin presentation folder of FIG. 2.
Figure 5:
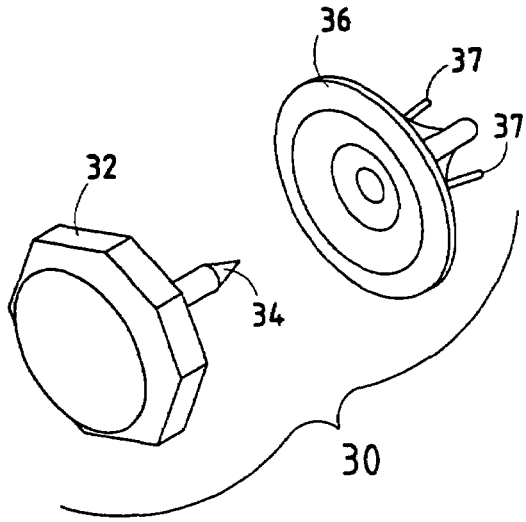
FIG. 5 is an exploded perspective view of an item of jewelry which may be used with the pin presentation folder of FIG. 1.

More particularly, as shown in FIG. 2, presentation device 2 includes first panel 10 hingedly connected to second panel 12 along first crease or fold 11. Crease 11 allows first panel 10 to be moved relative to second panel 12 while allowing panel 10 to be disposed over panel 12, at least partially, in an overlapping manner which is the closed position. In the alternative, an open position is illustrated in FIGS. 2 and 4. The open position, as used herein, indicates when first panel 10 is in a non-overlapping relationship with regard to second panel 12 such that a promotional area 18 is visible.

A preferred embodiment includes a third panel or flap 14 which is hingedly joined to and is an extension of second panel 12 along a second crease or fold 13 which allows third flap 14 to be positioned over and cover, at least partially, second panel 12 when presentation device 2 is in the closed position. Additionally, a slot 16 may be included in second panel 12 or, as shown, in third flap 14 along any free edge thereof to facilitate closure of presentation device 2 as described in further detail below.

Slot 16 may take various forms and configurations without departing from the inventive concept. In general, slot 16 is at least as wide as a shaft 34 of jewelry 30. Slot 16 is disposed on a panel of presentation folder 2 which is opposite to the panel having jewelry 30. In addition, slot 16 is disposed on this opposite panel in an in-line configuration with shaft 34 when the panels are in the closed position. For example, when jewelry 30 is disposed on first panel 10, slot 16 will be disposed on panel 14 (or panel 12 if panel 14 is not used) in a location which is longitudinally aligned with shaft 34 of jewelry 30 (FIGS. 2, 3 and 4) thereby allowing slot 16 to be positioned over shaft 34 when presentation device 2 is in the closed position. Slot 16 thereby effects closure of panel 14 (or 12 if panel 14 is not used) and allows the panel to be opened without requiring the removal of jewelry 30.

Presentation device 2 may be fabricated from numerous materials, countless geometries and although only two creases are illustrated, more or less may be used. In addition, panel 12 may simply be placed over panel 10 without the cards being hingedly connected at all (see FIG. 8). In a preferred embodiment, a cardboard or moderately thick paper is used along with three panels 10, 12 and 14. The three panels are attached through two folds 11 and 13 such that when presentation device 2 is in a closed position, panels 10 and 14 overlap panel 12.

Figure 3:
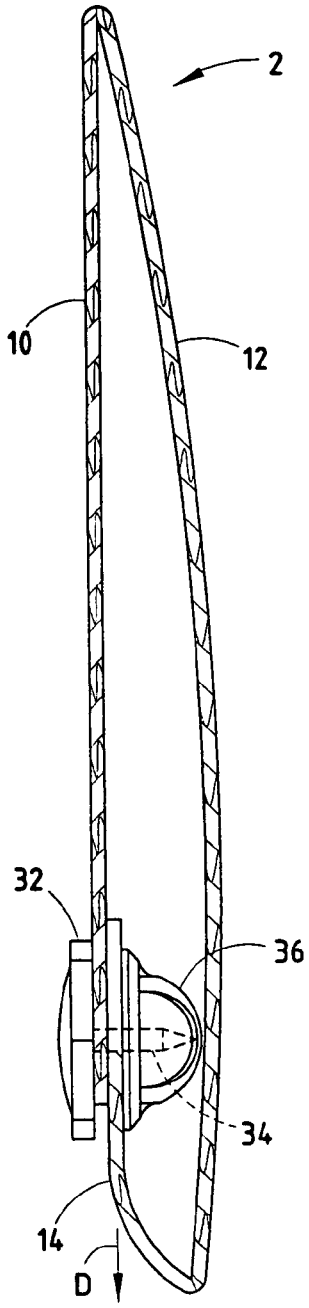
FIG. 3 is a sectional side view taken along line III-III of FIG. 1.

An item of jewelry 30 is releasably attached to at least one of the first, second and if supplied, third panels 10, 12 and 14, respectively, such that jewelry 30 acts as a closure for holding panels 10, 12 and/or 14 in their closed position when attached thereto and further can be used as an item of jewelry when detached therefrom. The specific item of jewelry may be varied. However, in a preferred embodiment, an item of jewelry having a body 32 with a shaft 34 projecting therefrom and a closure which engages shaft 34 is used. Preferably a clutch 36 which is releasably engaged with shaft 34 is used as the closure. For example, an earring, or a lapel pin may be used. Items of jewelry having the aforementioned shaft 34 and clutch 36 are particularly useful because clutch 36 can be secured to shaft 34 allowing first panel 10 and either second or third panel 12 or 14 to be retained between body 32 and clutch 36 thereby retaining presentation device 2 in the closed position (FIG. 3). However, clutch 36 is releasably engaged with shaft 34 by tabs 37. Therefore, by pinching tabs 37 towards one another a locking mechanism (not shown) is released allowing clutch 36 to be slid off of and removed from shaft 34 allowing jewelry 30 to be removed from panel 10 and used as jewelry. This manner of releasably affixing clutch 36 to shaft 34 is well known in the art and is for exemplary purposes only.

Although not meant to be limiting, body 32 will typically be the ornamental portion of jewelry 30 and may be designed with various shapes, ornamentation, messages or logos. For example, when jewelry 30 is a lapel pin, body 32 can be formed into a shape or a message which displays a promotional message, for example, the aforementioned college alumni pin. Alternatively, the lapel pin could be used to indicate a particular religious, social or political group. Still further, it is contemplated that an item of jewelry, such as a pair of earrings, could be used, thereby providing a novel way to present a card marking a special occasion, for example, a wedding anniversary.

Figure 8:
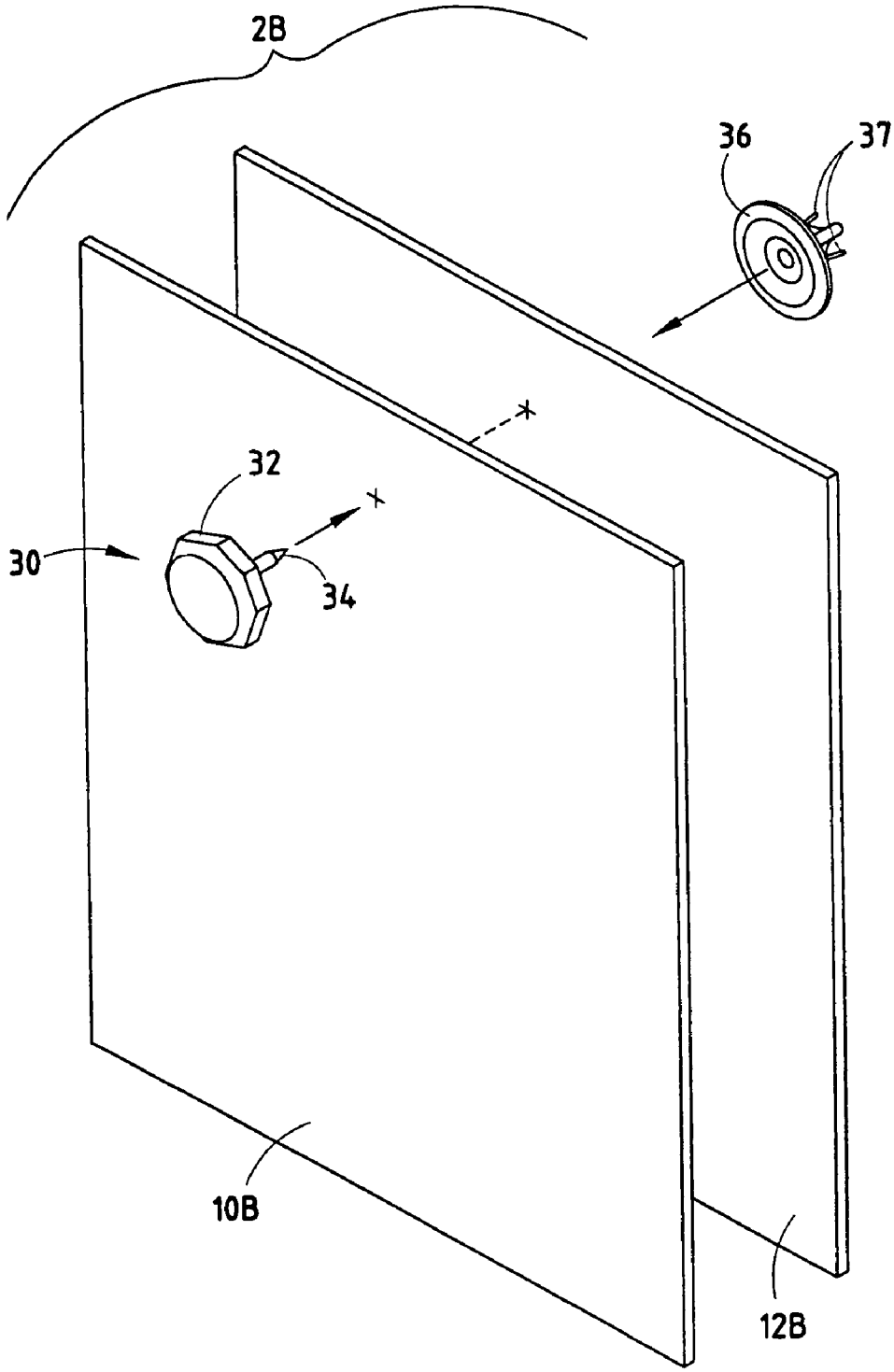
FIG. 8 is an exploded perspective view of a third embodiment of the pin presentation folder.

The use of presentation device 2 will now be described with respect to a three paneled, folded presentation device. However, two panels may be used and of course, more than three may be used. Further, the panels may or may not be hingedly connected. In fact, the panels need not be initially connected at all as illustrated in FIG. 8.

As best illustrated in FIG. 3, item of jewelry 30 is disposed on first panel 10 in a location which will, when first panel 10 is folded, be aligned with slot 16 of third flap 14. Jewelry item 30 may be disposed on panel 10 within an aperture, slot or other receiving geometry (not shown) or shaft 34 may simply be pierced through first panel 10. Clutch or clasp 36 is disposed on shaft 34 and retains jewelry 30 to first panel 10. Third panel 14 is folded and partially covers second panel 12. Slot 16 is fittingly disposed over shaft 34 between clutch 36 and first panel 10 placing presentation device 2 in the closed position wherein first panel 10, either alone or in conjunction with third panel 14, covers promotional area 18 of second panel 12.

Promotional area 18 may be used to promote or display text, images, documents or other forms of information or promotional matter. For example, as described above, a university could use promotional area 18 to store and display a student's diploma and use the college alumni lapel pin as the jewelry item. This gives the college the ability to give a student his or her diploma and college alumni pin in one functional promotional device. Alternatively, an organization could use presentation device 2 to give a valued worker an acknowledgement of his or her achievements to the company by presenting them presentation device 2 with a lapel pin shaped as the company logo wherein the reason for the award is displayed in promotional area 18. Still further, political, social or religious organizations could use presentation device 2 as a promotional or solicitation device and yet further, presentation device 2 could be used as a greeting card or other card marking a special occasion whereby the card and the jewelry item can be offered to the recipient as one piece.

To open presentation device 2, slot 16 is withdrawn from shaft 34. For example, third panel 14 can be moved in a direction D as indicated in FIG. 3 thereby removing slot 16 from its position on shaft 34. Once slot 16 of third panel 14 is removed from shaft 34, first panel 10 may be rotated upwardly while third panel 14 may be rotated downwardly to reveal promotional area 18. Of course, presentation device 2 is not limited to these specific configurations for opening and closing and numerous configurations may be used as long as the item of jewelry retains the presentation folder in a closed position and is removably attached thereto.

Figure 6:
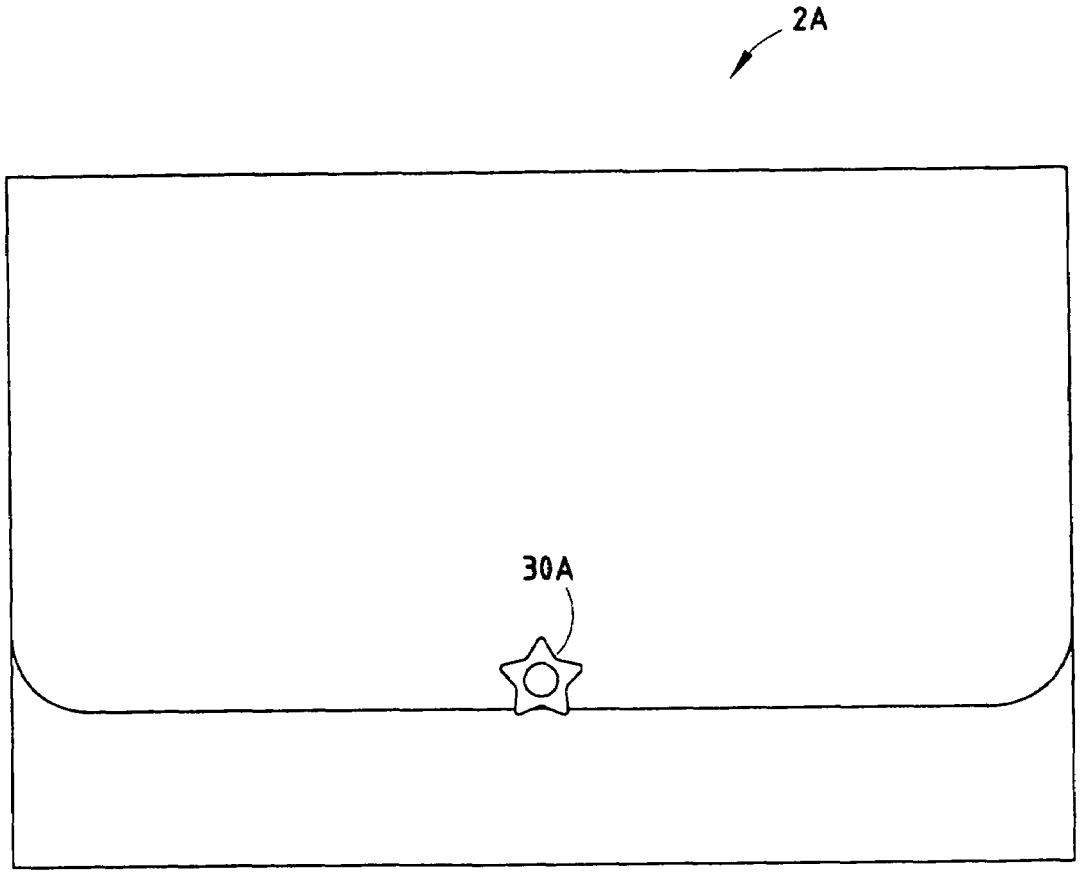
FIG. 6 is a plan view of a second embodiment of the pin presentation folder.
Figure 7:
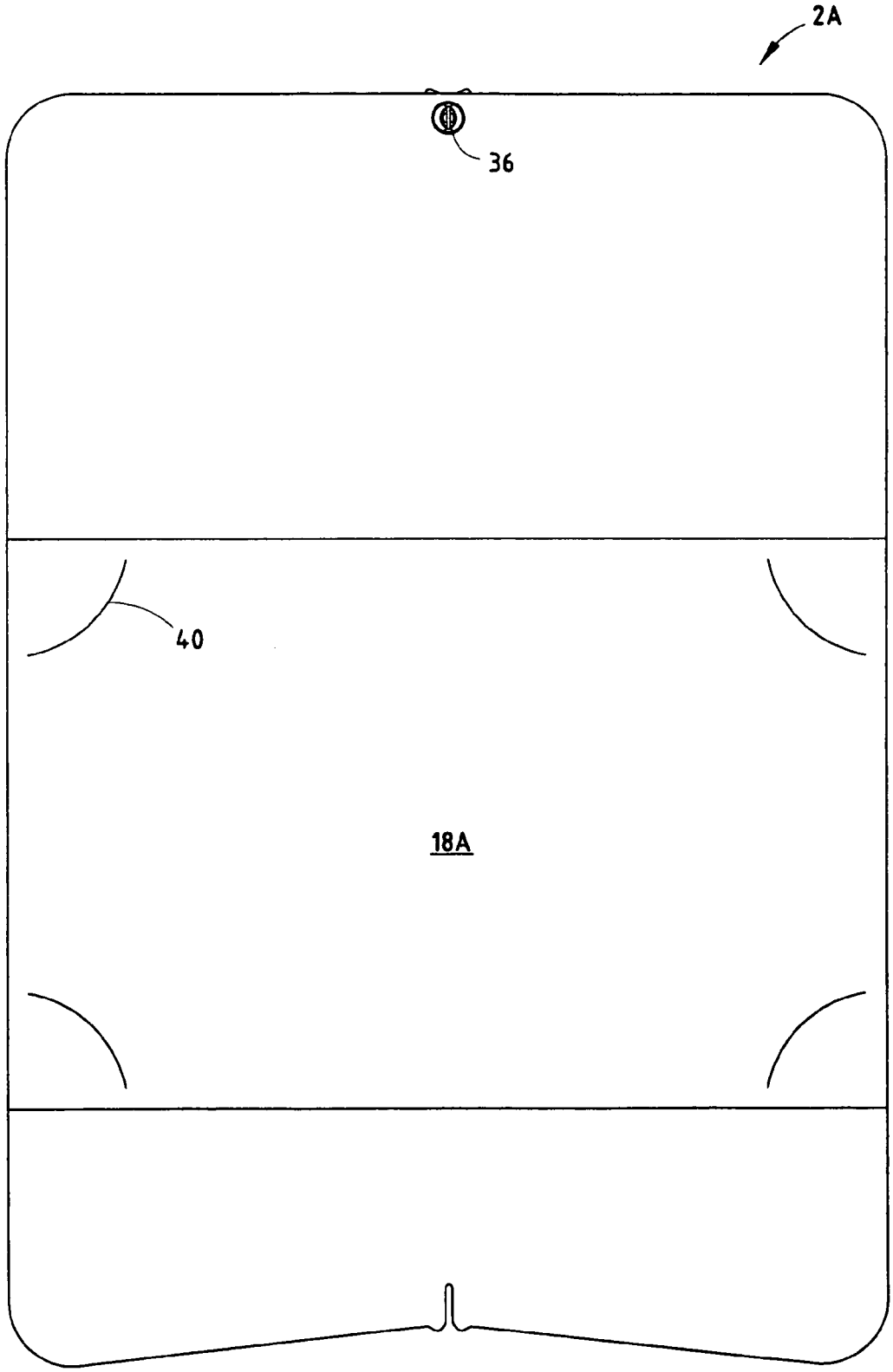
FIG. 7 is a plan view of the pin presentation folder of FIG. 6 in an unfolded state showing a first side.

FIG. 6 illustrates a second embodiment of the presentation device. As described previously, presentation device 2 may be fabricated from numerous materials and in innumerable geometric patterns, shapes, colors, etc. of which the second embodiment is one. As shown in FIG. 7, second embodiment 2A has, in addition to all of the features of the first embodiment, at least one retention device 40. Retention device 40 may be a mechanical, adhesive or other retention facilitating device, substance or method and is typically used to retain some form of a placard or card to promotional area 18A. For instance, a plurality of retention devices 40 comprising slots in the respective corners of promotional area 18A could be used to position and affix a card, placard, diploma or other promotional material to presentation device 2.

FIG. 8 illustrates a third embodiment of presentation device 2B. The third embodiment differs from the first and the second in that panels 10B and 12B are not initially connected to one another. Rather, the panels are affixed to one another through item of jewelry 30.

When presentation device 2 is in its closed position, a simple yet elegant folder is displayed wherein a lapel pin or other similar item of jewelry is displayed on the outside of the device while an optional message is obscured from view inside the folder. The message or other indicia may be printed inside the folder, or it may be a separate item retained in the folder. This manner of presentation has at least two characteristic features. The first is that in order for a person to use the lapel pin, the lapel pin must be removed from presentation device 2, thereby revealing the promotional message within. Secondly, jewelry item 30 acts as a securing means or lock keeping the promotional message in area 18 from being viewed. This usually entices or arouses the curiosity of a person, wherein the person becomes desirous to see what is displayed inside and consequently seeks to open the presentation device. Therefore, a novel, simple and eloquent promotional device has been described herein.

Of course, it is to be understood that the foregoing are preferred embodiments and changes and variations can be made without departing from the spirit and broader aspects of the invention as defined in the appended claims, which are to be interpreted in accordance with the principles of patent law, including the doctrine of equivalents.

The invention claimed is:

1. A presentation device comprising:

first and second panels hingedly joined such that they can open or close with respect to each other; and an item of jewelry releasably attached to said panels such that it acts as a closure for holding said panels in a closed position when attached to said panels, and such that it can be used as jewelry when detached from said panels;

said item of jewelry including a body with a shaft projecting therefrom, and a clutch secured to said shaft;

said item of jewelry being secured to said first panel, said shaft extending through said first panel with said body on one side thereof and said clutch on the other side;

said second panel having a slot extending into said second panel from a free edge thereof; and said item of jewelry being attached to said second panel by said shaft extending through said slot with both of said first and second panels being held between said body and said clutch, whereby said panels can be opened by sliding said slot of said second panel off said shaft.

2. The device of claim 1, in which:

said second panel further includes a flap hingedly connected to said second panel; and said slot is disposed on said flap along an edge not hingedly connected to said second panel.

3. The device of claim 2, in which:

said clutch is releasably secured to said shaft.

4. The device of claim 1, in which:

said clutch is releasably secured to said shaft.

5. The device of claim 1, in which:

a promotional message, advertisement, logo or the like is disposed on said second panel.

6. The device of claim 1, in which:

said item of jewelry includes a lapel pin.

7. A presentation device comprising:

an item of jewelry; and a first panel and second panel, the first and second panel being movable relative to one another;

wherein the first panel is secured to the second panel by the item of jewelry;

said item of jewelry including a body with a shaft projecting therefrom, and a clutch secured to said shaft;

said item of jewelry being secured to said first panel, said shaft extending through said first panel with said body on one side thereof and said clutch on the other side;

said second panel having a slot extending into said second panel from a free edge thereof; and said item of jewelry being attached to said second panel by said shaft extending through said slot with both of said first and second panels being held between said body and said clutch, whereby said panels can be opened by sliding said slot of said second panel off said shaft.

8. The device of claim 7, in which:

said second panel further includes a flap hingedly connected to said second panel; and said slot is disposed on said flap along an edge not hingedly connected to said second panel.

9. The device according to claim 8, wherein:

said item of jewelry is secured to said first panel, said shaft extending through said first panel with said body on one side thereof and said clutch on the other side.

10. The device of claim 7, in which:

a promotional message, advertisement, logo or the like is disposed on said second panel.

11. The device of claim 7, in which:

said item of jewelry includes a lapel pin.

12. A method of securing a presentation device in a closed position with an item of jewelry whereby the item of jewelry may be removed from the presentation device and used as jewelry comprising:

providing a first panel and a second panel, said first and second panel being movable relative to one another;

providing an item of jewelry;

covering said second panel, at least partially, with said first panel; and affixing said first panel to said second panel with said item of jewelry;

said item of jewelry further including a body, a shaft and a clutch;

said second panel including a slot extending into said second panel from a free edge thereof; and said item of jewelry is attached to said second panel by said shaft extending through said slot with both of said first and second panels being held between said body and said clutch, whereby said panels can be opened by sliding said slot of said second panel off said shaft.

13. The method of promotion of claim 12, in which:

said second panel further includes a flap hingedly connected to said second panel; and said slot is disposed in said flap along an edge not hingedly connected to said second panel.

14. A method of securing a presentation device in a closed position with an item of jewelry whereby the item of jewelry may be removed from the presentation device and used as jewelry comprising:

providing a first panel and a second panel, said first and second panel hingedly joined such that they can open or close with respect to each other;

providing an item of jewelry;

covering said second panel, at least partially, with said first panel; and affixing said first panel to said second panel with said item of jewelry;

said item of jewelry further including a body, a shaft and a clutch;

said second panel including a slot extending into said panel from a free edge thereof; and said item of jewelry is attached to said second panel by said shaft extending through said slot with both of said first and second panels being held between said body and said clutch, whereby said panels can be opened by sliding said slot of said second panel off said shaft.

15. The method of promotion according to claim 14, wherein:

said item of jewelry is secured to said first panel, said shaft extending through said first panel with said body on one side thereof and said clutch on the other side.

16. The method of promotion of claim 14, in which:

said second panel further includes a flap hingedly connected to said second panel; and said slot is disposed in said flap along an edge not hingedly connected to said second panel.

* * * * *